US005125785A

United States Patent [19]

Langen et al.

[11] Patent Number: 5,125,785

[45] Date of Patent: Jun. 30, 1992

[54] DEVICE FOR DISCHARGING A CONTAINER

[75] Inventors: Christianus P. Langen; Johannes C. Langen, both of Cuijk, Netherlands

[73] Assignee: Langen Research B.V., Cuijk, Netherlands

[21] Appl. No.: 629,563

[22] Filed: Dec. 18, 1990

Related U.S. Application Data

[63] Continuation-in-part of Ser. No. 512,525, Apr. 18, 1990, abandoned, which is a continuation of Ser. No. 193,507, May 12, 1988, abandoned.

[30] Foreign Application Priority Data

May 14, 1987 [NL] Netherlands ..... 8701165

[51] Int. Cl.[5] ..... B65G 65/36

[52] U.S. Cl. ..... 414/416; 414/403; 222/162; 222/387

[58] Field of Search ..... 414/403, 417, 288, 287, 414/309, 287, 416; 222/160, 162, 387

[56] References Cited

U.S. PATENT DOCUMENTS

| | | | |
|---|---|---|---|
| 1,598,970 | 9/1926 | Kasper | 222/387 X |
| 2,826,341 | 3/1958 | Stephan | 222/162 X |
| 3,611,951 | 10/1971 | Sloan | 222/387 X |
| 4,742,940 | 5/1988 | Wilkinson | 222/162 |
| 4,6620,794 | 11/1986 | Leka | 222/387 |

FOREIGN PATENT DOCUMENTS

| | | | |
|---|---|---|---|
| 18683 | 7/1882 | Fed. Rep. of Germany | 222/387 |

*Primary Examiner*—Frank E. Werner
*Attorney, Agent, or Firm*—Fetherstonhaugh & Co.

[57] ABSTRACT

A device for discharging a container of the type which has a cylindrical load storage compartment. The device is in the form of a plunger which has a discharge passage opening therethrough. A conduit is connected to the discharge passage and a driving mechanism is provided for moving the plunger relative to the container so that the contents of the container are compressed between the plunger and the container and are expelled from the container through the discharge passage and through the conduit.

17 Claims, 3 Drawing Sheets

DEVICE FOR DISCHARGING A CONTAINER

CROSS-REFERENCES TO RELATED APPLICATIONS

This application is a continuation-in-part of application Ser. No. 07/512,525 filed on Apr. 18, 1990, now abandoned, which is a continuation of application Ser. No. 07/193,507 filed May 12, 1988 now abandoned.

BACKGROUND OF THE INVENTION

The invention relates to a device for the discharging of a container having a cylindrical cross section.

The device according to the invention is in particular intended for application in those systems where the containers are used not only as treatment containers but also as transport and storage containers. These containers are usually emptied by tilting them so that the contents flow out. This is not only laborious but, moreover, not very hygienic, while working under a vacuum during the discharging is difficult to realize.

The invention has for its aim to provide a device whereby the above stated drawbacks are obviated and whereby a container with a cylindrical cross section can be emptied in a simple, effective and hygienic manner.

The device according to the invention is distinguished by a body whereof the girth corresponds to the cylindrical cross section, said body being provided with a passage opening, a transporting conduit system connected to that passage opening, and driving means for conveying that body respectively into and out of the container.

Owing to the use of the likewise cylindrical body, the cross section of the container is completely closed off so that the contents are also completely covered. The contents are delivered through the passage opening in the body to the transporting conduit system by gradually inserting the body further into the container, whereby the contents are displaced out of the container.

By preference, the periphery of the body is provided with a sealing ring which cooperates with the inside wall of the cylindrical container.

In order to prevent the mass to be transported from falling out of the transporting conduit system during exchanging of the container, the passage opening is by preference formed with a closure means.

To enable discharging under a vacuum, a cover for the container enclosing the body is provided, said cover being equipped with a vacuum connector stub. Furthermore at least one projection deforming the sealing ring may be arranged in order to effect in a simple manner a communication between the vacuum connector stub, the cover and the contents of the container, so that this latter can be brought under a vacuum.

SUMMARY OF THE INVENTION

In a preferred embodiment, the transporting conduit system is embodied with a hollow column suspended in a frame and provided with the body at its lower end, the cover displaying an opening accommodating said column, such that the cover is slidable along the column, and whereby the driving means take the form of lifting means. Hereby results, in a particularly simple manner, a container-discharging device in which the container does not have to be tilted and can easily be brought into and respectively out of the device, even more so when the container is executed with transport wheels.

The above stated and other characteristics will be elucidated in the figure description below of two embodiments.

DESCRIPTION OF THE PREFERRED EMBODIMENTS

Figure 1:
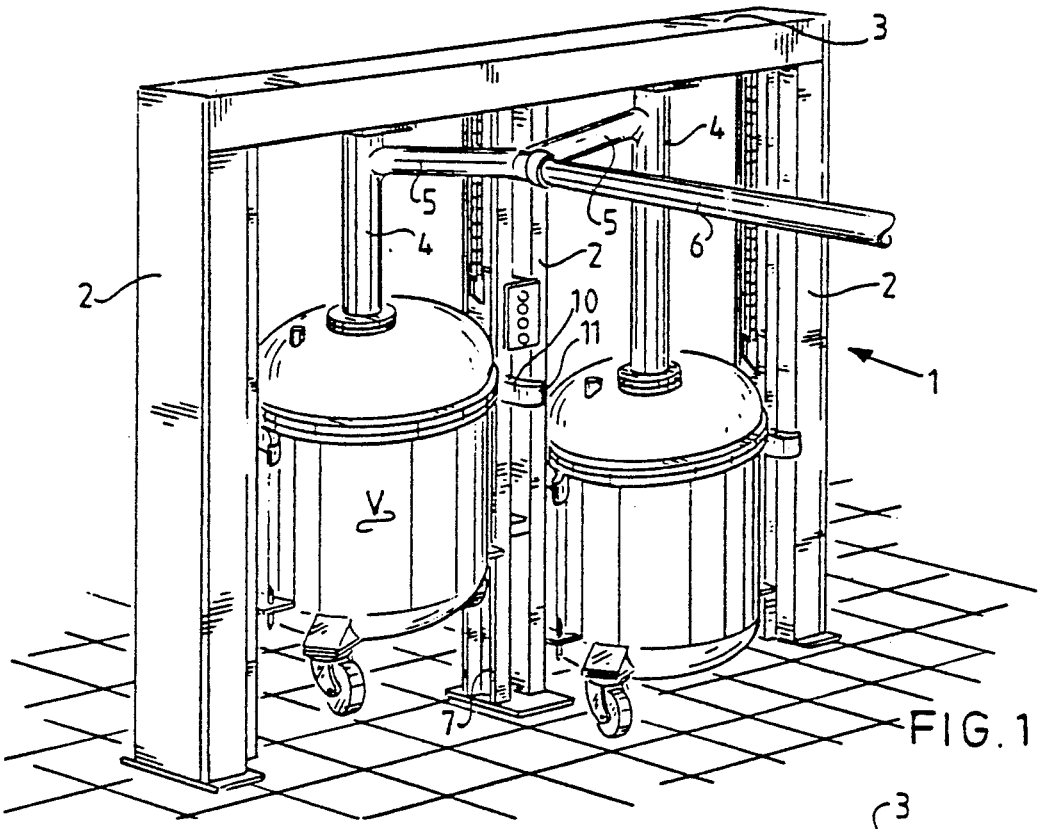
FIG. 1 shows a perspective front view of the device embodied with two suspended columns for the treatment of two containers.
Figure 2:
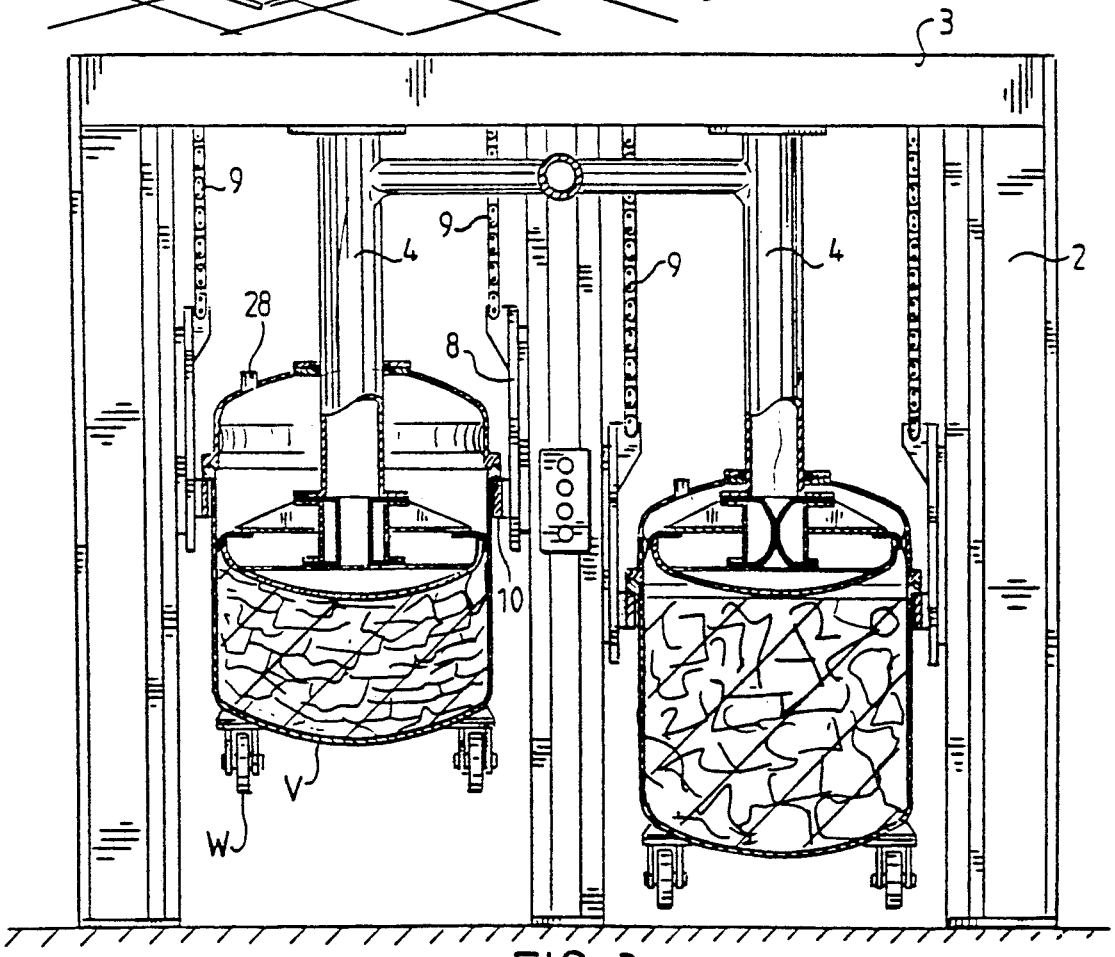
FIG. 2 shows a front view, partly in section, of the device of FIG. 1.
Figure 3:
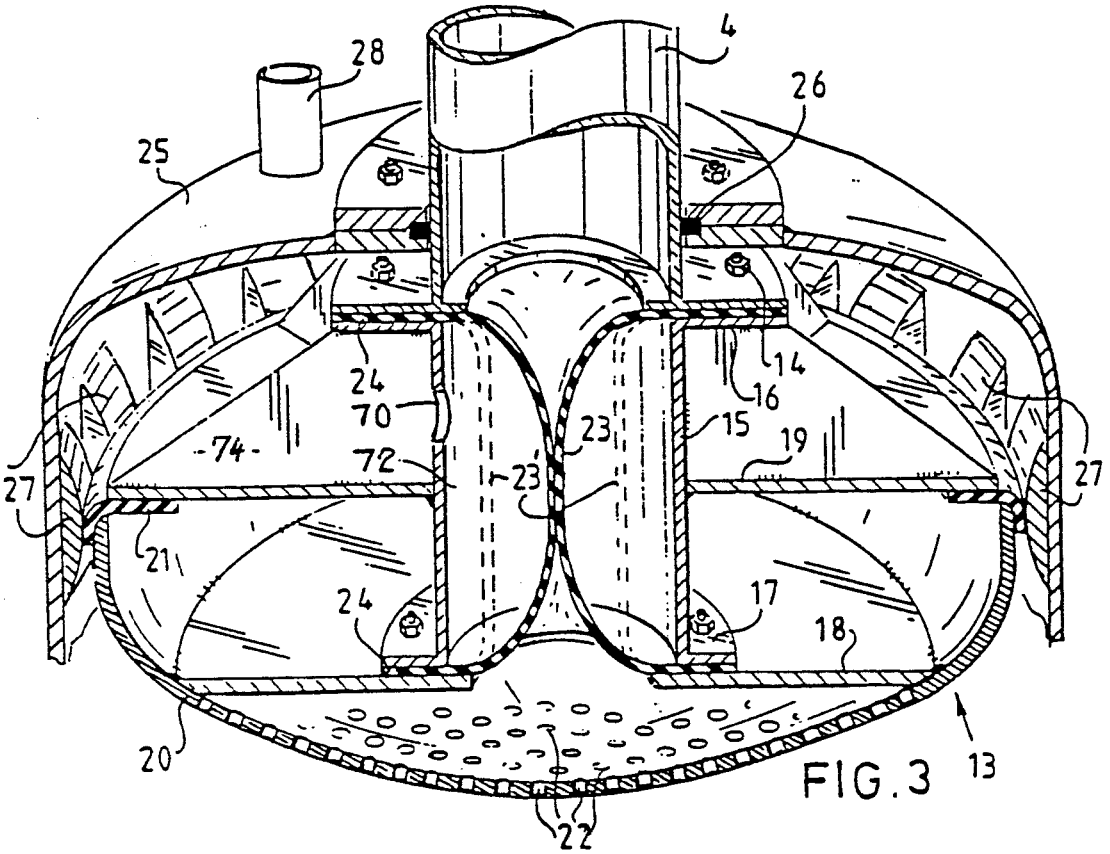
FIG. 3 shows a longitudinal section in perspective view of the body with cover used in the device of the foregoing figures.

In the FIGS. 1 to 3, numeral 1 indicates a frame consisting of three adjacently arranged pillars 2, which are firmly joined at the top by a horizontal beam 3. Centrally between each adjacent pair of pillars 2 is suspended from top beam 3 a hollow column 4, which is formed with a branch stub 5 at the top, which branch stubs converge in a common discharge conduit 6.

Each pillar 2 has on the side facing the opposite pillar a guide 7 for a slide 8 arranged movably up and down therein. The slide 8 is suspended from a lifting chain 9, which chain is driven for movement in upward and downward direction by drive means (not shown).

The slide 8 has a bracket 10 in the form of a horizontally extending strip which is bent around at the ends 11 that protrude outside the frame 1.

In FIGS. 2 and 3 it is clearly visible that the bottom end of the column 4 is formed with an outward projecting flange 12, to which a body 13 is bolted into position by means of bolts 14.

The body consists substantially of a tubular central part 15 which is made on its upper side with an outward protruding flange 16 for the fastening to flange 12, and on its underside with a corresponding outward turned flange 17 for the fastening of an under plate 18. Halfway in the height of cylindrical part 15, a middle plate 19 is mounted parallel to the flanges 16 and 18. The periphery of this plate 19 agrees closely with the transverse section circumference of the container V (see FIG. 2).

The under plate 18 is secured by welding along its periphery to a domed bottom plate 20, which bottom plate corresponds in curvature to the curvature of the bottom of the container V.

Along the outer circumference of the middle plate 19 is mounted a sealing means in the form of a sealing ring 21 of flexible material such as rubber, which is moved along the inside wall of the container V and cooperates sealingly therewith. The domed bottom plate 20 is in contrast perforated with holes 22 for the through passage of the mass to be transported out of the container V.

Arranged in the central part 15, which has a circular cylindrical transverse section, is a closure means 23 which is manufactured of elastic material. In the position shown in FIG. 3, the closure means is shown in the closed position, but it should be noted that in the relaxed state the closure means has a nearly tubular shape, which is indicated by dotted lines 23' in FIG. 3. The tubular portion is narrower in diameter than the tubular central part 15, and is formed at the top and bottom ends with flanges 24, which are clamped securely at the top end between flanges 12 and 16, and at the bottom end between flange 17 and under plate 18. A passage 70 is formed in the central part 15 and communicates between the chamber 72 which is formed between the closure member 23 and the central part 15 and the compartment 74 which is formed within the cover 25.

In FIGS. 2 and 3 it is moreover shown that the column 4 supports a cover 25 with a bell-like shape. In the top portion of the cover 25 an opening is shaped for the accommodation of the column 4, which opening is made with a sealing ring 26, such that a sliding of the cover along the column 4 is possible, but a sealing effect is ensured.

Arranged on the inside of the bell-shaped cover 25 are one or more projections 27 which ensure that the sealing ring 21 is locally deformed and stands free of the inner surface of the cover 25.

Finally, the cover is formed with a connector stub 28 to which a vacuum line can be connected.

The device as described hereinabove works as follows.

A container V with a certain contents, for example treated meat, that has been reduced to a paste-like mass, is rolled under one of the two gantries, this being possible because the container V is made with castors W. The top edge of each container V is so positioned that it closely tallies with the bottom edge of the cover 25, which is suspended in its lowest position at the bottom of the column 4 and which completely encompasses the body 13. On the introduction of the container V, each horizontal bracket 10 of slide 8 will be located under the thickened top edge of the container V.

Through the pressing of the control knobs on the control panel 29, the slide 8 can be moved in an upward direction by means of the chains 9, so that the brackets 10 lift up the thickened edge of the container V and, in so doing, the container V itself. The top edge hereby comes into contact with the bottom edge of the cover 25. This situation is shown on the right in FIG. 2.

It should be noted that the closure means 23 still closes off the hollow column 4 at the bottom. The atmospheric pressure displaces the closure member to the position shown in solid lines in FIG. 3, it being assumed hereby that a vacuum prevails in the column 4.

Subsequently a vacuum can be brought to bear in the compartment 74 of the cover 25 through vacuum connector stub 28, and on account of the deformation of the sealing ring 21 by the projections 27 also in the container V. Owing to the vacuum suction, the entire contents of the container V and the cover 25 and the chamber 72 are brought under the same pressure as that prevailing in the column 4, so that the closure means 23 can recover in form and assumes the shape as shown at the left in FIG. 2.

On further raising of the slides 8 and thus of the container V, the body 13 is carried further into the container V. The domed bottom wall 20 of the body 13 displaces the contents out of the container through the holes 22 and brings these contents into the column 4. This process continues until the domed wall 20 reaches the bottom of the container V.

Subsequently the slides 8 can again be moved downward along the pillars 2, whereby the container V descends and the body 13 withdraws from the container. As soon as the container reaches the position shown at the right in FIG. 2, the vacuum may be released so that the container contents can be brought under atmospheric pressure. This pressure will immediately deform the closing member 23 into the shape such as is shown in solid lines in FIG. 3, whereby the column 4 is closed off from the atmosphere. On further lowering of the slides 8, a parting will take place between the top edge of the container V and the bottom edge of the cover 25, after which the container may be rolled away.

It will be apparent that the shown embodiment can repeatedly empty two containers in alternation. In this way the conduit system 6 can be fed nearly continuously.

FIGS. 4 to 8 inclusive show a second embodiment of a container discharging device according to the invention, in which figures the same components are indicated by the same reference numerals.

Figure 4:
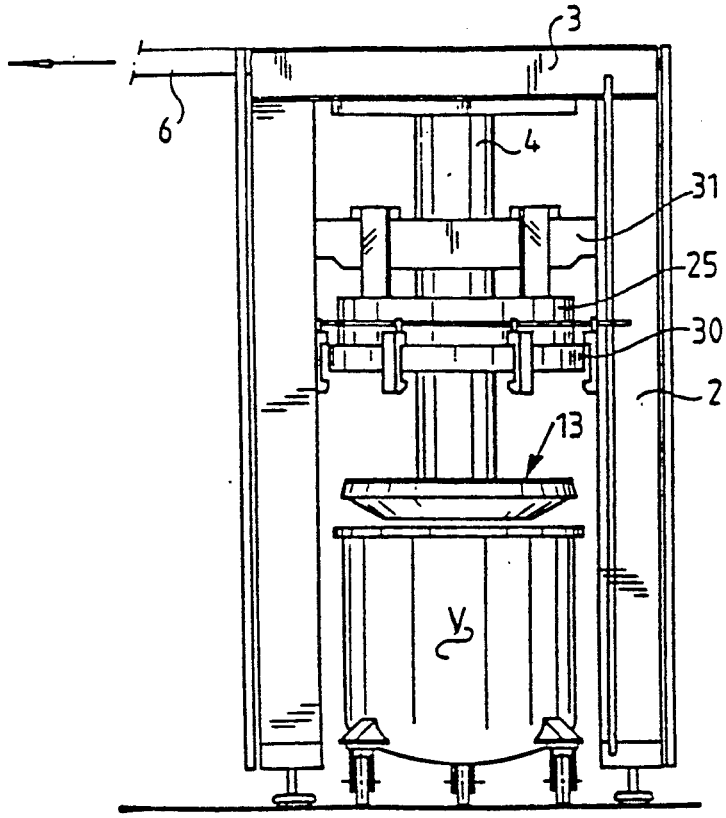
FIG. 4 shows a summary view corresponding to FIG. 2 of a second embodiment with one column.

Thus the device according to FIG. 4 consists of a frame with pillars and a top beam 3, such that the container V can be rolled to between the pillars. From the top beam 3 is suspended a hollow column 4, at the bottom end of which the body 13 is mounted. Along the column 4 the cover 25 is guided slidably up and down, the cover being also provided with operable clamping means in the form of a plurality of hooks 30, which will be elucidated hereinbelow.

The cover 25 is in this embodiment suspended from a cross beam 31, which is moveable up and down along the pillars 2 by driving means (not shown), for example hydraulic cylinders.

The hollow column 4 stands in communication with a discharge conduit 6.

The body 13 used in this embodiment does not here take the form of a hollow construction composed of plate material, but instead as a solid disc 13 around which a ring 32 is arranged. The ring 32 serves for the clenching of a sealing ring 21, whereof the flexible downward-pointing edge portion cooperates for sealing with the inside wall of the container V to be handled.

Incorporated in solid disc 13 is a passage opening 33, which displays a cylindrical shape in the top portion thereof, which portion then widens conically in a downward direction. In the conical portion fits a conically formed valve 34, which is provided at its upper side with a pad 35 arranged at some distance from the valve 34 (see also FIG. 7). The distance between pad 35 and valve 34 is such that the valve can undergo a specific vertical motion with respect to the hole 33 and therefore can, respectively, close or open the hole. The pad 35 is formed with passages 76 which open therethrough.

Arranged on the underside of the cover 25 is a stop 36 corresponding with the centre line of the valve 34.

The lower edge portion 37 of the cover 25 is formed on its underside with a circumferential groove 38, in which fits a rubber sealing means 39. The height of the sealing means 39 is less than the depth of the groove 38, so that it can undergo a free movement therein in a vertical direction. It is to be noted that the under surface 40 of the outer wall of the groove 38 is situated lower lying than the bottom edge of the inner wall part 41.

The internal diameter of the outer wall part 40 is nearly equal to the external diameter of the thickened upper edge of the container V. Moreover, the breadth of the groove 38 is equal to the thickness of the top edge of the container V, so that the edge can be accommodated in the groove 38.

Figure 8:
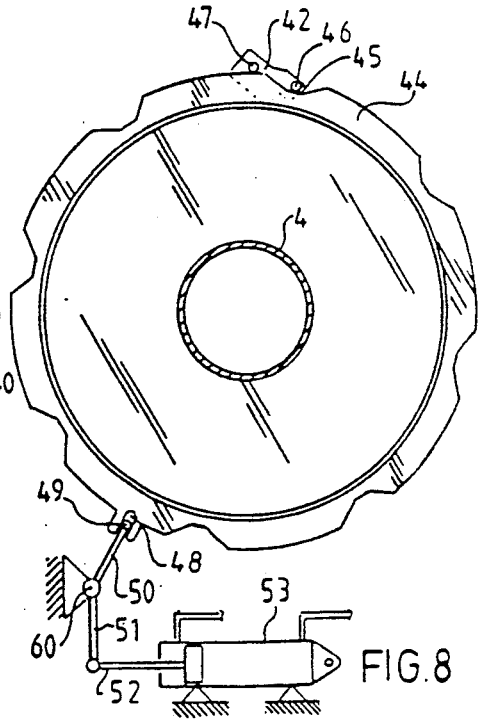
FIG. 8 shows a schematic top view of the locking mechanism of the cover.

For the clamping of the cover 25 onto the container V, the edge part 37 of the container is provided with hook-shaped members 42, which are arranged at a regular distance from one another (see also FIG. 8).

Figure 5:
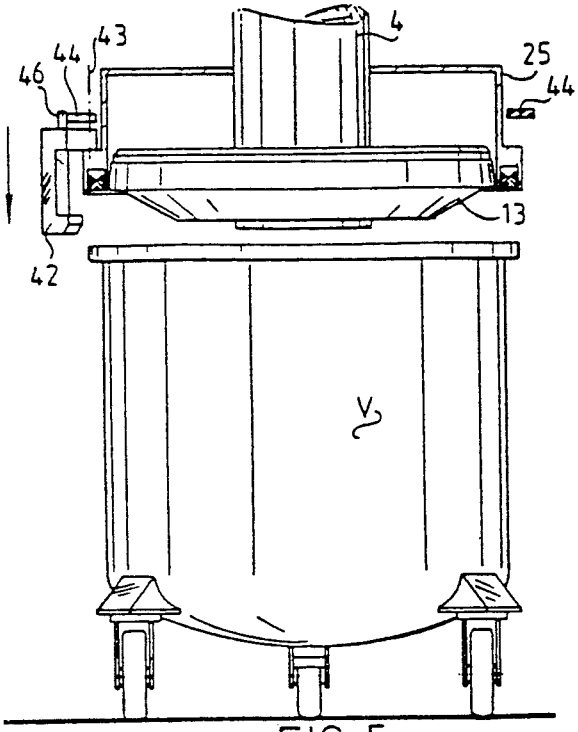
FIGS. 5 and 6 show a detail of FIG. 4 on enlarged scale of the container with closure means and cover in the opened and in the closed position respectively.
Figure 6:
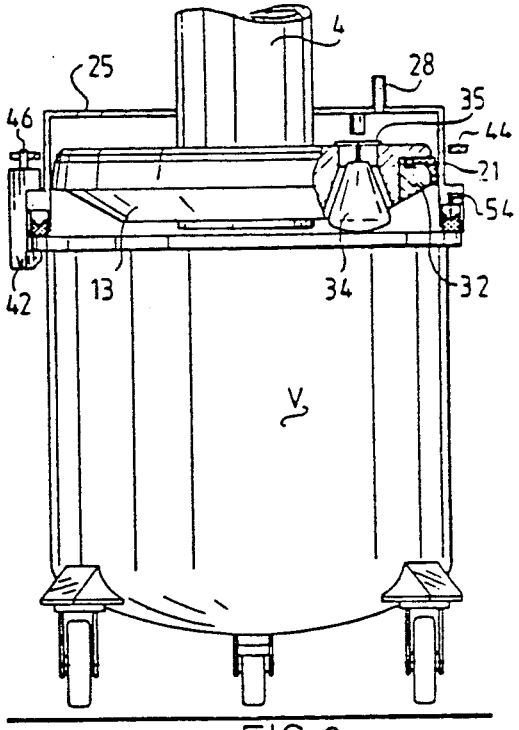

Each hook-shaped member 42 is coupled to the edge part 37 for pivoting around a line 43, so that the hook-shaped members can pivot from the position of FIG. 5 (the spread position) to the position in FIG. 6 (the clamping position).

This pivoting movement comes about through a ring 44 which is freely turnable about the lid 25 and which is formed on its periphery with recesses 45, which are equal in number to the hook-shaped members 42. The hook-shaped member is further provided with two pins, 46 and 47 respectively, which both co-act with the outer edge of the ring 44.

The ring is further provided with a slot-shaped opening 48 into which falls a rod 49. The rod 49 extends over the whole height of the column 4, so that the ring 44 is in engagement with the rod 49 at any height.

At its top and bottom ends, the rod is provided with an arm 50 which is joined at 60 for pivoting to the frame. At the top or bottom of the rod 49, the arm 50 is lengthened by a portion 51, which engages with the piston rod 52 of a piston cylinder system 53. As a result of the movement of the piston in the cylinder the rod 50, 51 will pivot around the hinge 60 and therefore cause the ring to rotate through a certain angular distance around the cover 25. As a result of the movement of the recesses 45 the pins 46, 47 are moved with respect to the pivot point 43 of the hook-shaped members 42, whereby the two above described position of the hook-shaped members 42 are obtained, dependent on the position of the ring 44.

Finally it is noted that the groove 38 stands in connection with a pressure source via pressure supply conduit 54.

The above described device works as follows.

After the placing of the container V between the pillars 2 of the frame, the cover 25 can be moved downward along the column 4, it being assumed hereby that the ring 44 is so turned that the hook-shaped members 42 adopt the position according to FIG. 5. Since the lower edge 40 of the cover 25 is lower lying than the edge 41, the edge of the cover 25 is to a certain extend self-locating and the thickened top edge of the container V will easily be guided into the groove 38. On further downward movement of the cover 25, the sealing means 39 is pushed upwards into the top of the groove 38. Once this position has been attained, the ring 44 can be pivoted by the actuation of the cylinder 53, such that the hook-shaped members 42 pivot into the position according to FIG. 6. Since the edge of the container V is located in groove 38 this can take place without disturbance.

Through the subsequent pressurization of the groove 38 with a pressure means via conduit 54, the sealing means 39 is pushed downward against the thickened edge of the container V, which is restrained by the hooks 42. The sealing ring 39 simultaneously closes the cover 25 airtight onto the container V. The vacuum can then be brought through connection stub 28 into the cover 25, which, because of the position of the valve 34 in the passage opening 33, stands in open communication through the passages 72 in the pad 35 with the contents of the container V, so that these also come into contact with the vacuum. The cover 25 can subsequently be moved upwards by the raising of the yoke 31 along the pillars 2. The body 13 thereby presses the contents out of the container in the way described hereinabove according to the embodiment of FIGS. 1-3, it being assumed hereby that also the column 4 is provided with a sealing means 23 according to FIG. 3.

Figure 7:
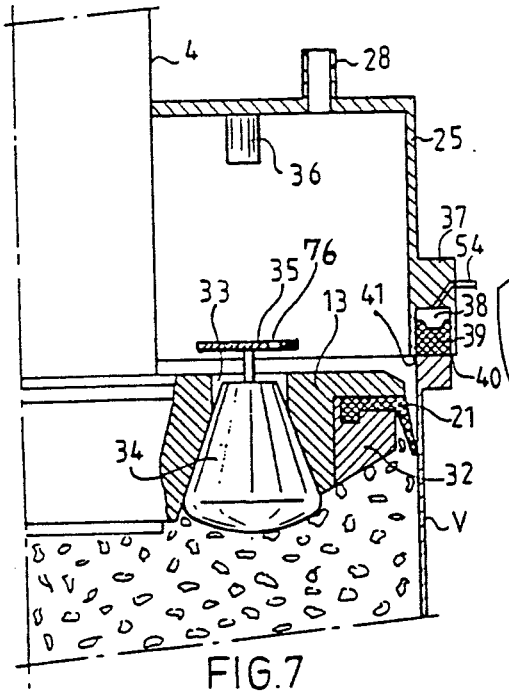
FIG. 7 shows a detail of the closure means with safety valve in the opened position.

Since the contents in the container V also push the valve 34 upwards according to FIG. 7, the opening 33 will be closed and none of the mass can thus come into the cover 25.

Should there be an unforeseen absence of contents in the container V, then the valve body 34 remains in the position according to FIG. 6, and the container V will not be brought under pressure during the raising process on account of the residuum of air in the container, so that risk of explosion is avoided.

Owing to the fact that the ring 44 is continually in contact with the rod 49, the ring 44 cannot accidentally fall loose when the container V is raised up. The rod 49 therefore forms not only a control means but also a security measure.

At the end of the cycle, the container V may be brought downward again, the ring 44 may be turned by the reversal of the cylinders 53 and the hook-shaped members 42 can be released, whereafter the container V can be removed.

In the meantime, the stop 36 has come into contact with the pad 35 of the vale 34, which is again pushed into the position of FIG. 6.

The device is then ready for the next cycle.

The invention is not restricted to the above described embodiment. Thus the body 13 does not have to be arranged fixedly in a frame 2, but may be inserted in a mobile form into a stationary container. Neither is the invention restricted to a device in which a vacuum is applied.

We claim:

1. Device for discharging a container with a cylindrical transverse section, characterized by a body whereof a girth thereof corresponds to a cylindrical cross section of the container, said body being provided with a passage opening, a transporting conduit system connected to the passage opening, and driving means for conveying the body respectively into and out of said container, a cover for the container enclosing the body, said cover being equipped with a vacuum connector stub, whereby a closable opening is arranged along the body, the transporting conduit system being provided with a hollow column suspended in a frame, at the lower end of which column the body is firmly mounted, the cover has an opening receiving the column with a sealing ring, and the driving means comprises lifting means movable up and down along said frame.

2. Device as claimed in claim 1, characterized in that the body has a circumference which is provided with a sealing ring.

3. Device as claimed in claim 1, characterized in that the passage opening is formed with a closure means.

4. Device as claimed in claim 3, characterized in that the closure means is a cylindrical lining of elastic material arranged in the passage opening.

5. Device as claimed in claim 1, characterized in that at least one projection deforming the sealing ring is provided.

6. Device as claimed in claim 1, characterized in that the passage opening widens conically downward and a conical valve body is accomodated in the opening.

7. Device as claimed in claim 1, characterized in that around the cover a control ring is arranged for the operation of pivotable hook-shaped members mounted around a circumference of the cover.

8. Device as claimed in claim 1, characterized in that a control ring cooperates with a control rod extending parallel to the hollow column.

9. Device as claimed in claim 1, characterized in that a bottom edge of the cover is formed with a continuous groove-like channel, in which a sealing means is accommodated for free movement.

10. Device as claimed in claim 9, characterized in that the channel is formed with a connection channel for a pressure source.

11. A device for discharging contents of a container which has a cylindrical-shaped load storage compartment which has an open end and a closed end, said device comprising;

a) a cover which is proportioned to fit over and to close an open end of the load storage compartment of the container, said cover having an underside in which a recess is formed, b) first vacuum passage means opening through said cover into said recess, c) a plunger which is proportioned to fit within said cylindrical-shaped load storage compartment and within said recess of said cover in a close-fitting sliding relationship, said plunger cooperating with said cover when located therein to form a first vacuum chamber therebetween, d) conduit means supporting said plunger and providing a load discharge passage which open through said plunger through which the contents of the container may be discharged as the plunger is driven into the load storage compartment in a use position, said conduit extending through said cover and being movable relative to said cover, e) conduit closure means mounted in said discharge passage and being movable to and fro between an open position and a closed position to open and close said conduit as required in use, f) means for moving the plunger with respect to the container which is to be discharged and said cover to cause the plunger to reciprocate within the load storage compartment of the container to move into the load storage compartment to expel the contents from the compartment through the conduit and then be withdrawn from the compartment as required in a non-use position.

12. A device as claimed in claim 11, wherein the plunger has a sealing ring at its peripheral edge which bears against the cover to form said first vacuum chamber when the plunger is withdrawn into the recess, and a vent means said vent means comprising ridge means formed on an inner face of said recess which serves to break a seal formed between the cover and the plunger when the plunger is withdrawn to a predetermined location within said cover whereby a vacuum drawn within said first vacuum chamber may be applied to the load storage compartment of a container on which the cover is seated in use.

13. A device as claimed in claim 11, wherein said conduit closure means comprises a flexible diaphragm which has a through passage which communicates with the discharge passage of the conduit and a pressure chamber which is located between the diaphragm and the conduit and said pressure chamber being connectable to a source of pressure such that application of a predetermined pressure to the pressure chamber will cause the diaphragm to move from an open to a closed position and removal of the predetermined pressure will cause the diaphragm to return to its open position.

14. A device as claimed in claim 11, further comprising;

vent means movable between an open position and a closed position and serving to communicate between a first vacuum enclosure and an underside of said plunger when open, such that a vacuum which is drawn in said first vacuum chamber may be applied through a vent means to the load storage compartment of a container in use and which when closed, serves to prevent passage of the contents into said first vacuum chamber as the contents is discharged from the load storage compartment in the use position.

15. A device as claimed in claim 14, wherein said vent means comprises a passage which open through said plunger and serves to communicate between said first vacuum passage and said load storage compartment in the use position and a vent closure member which is slidably mounted in a vent passage for movement between a first position in which the vent passage is open and a second position in which the vent passage is closed, said closure member being mounted so as to be displaced to the closed position by contact with the contents which is located within the load storage compartment as a plunger is driven toward the closed end of the load storage compartment in the use position to prevent the passage of the contents through the vent passage.

16. A device as claimed in claim 11, wherein a plurality of clamping members are mounted on said cover at spaced intervals about a perimeter thereof and are mounted for movement between a released position in which the latching lug of each clamp is spaced radially outwardly from the cover and a latching position in which a latching arm is arranged to extend radially inwardly to underlie a lip located at an upper end of each container and wherein an actuator ring extends around the cover and operably engages each of the latching members and wherein drive means is provided for driving the ring around the cover to simultaneously move the latch members to and fro between their open and closed positions.

17. A device as claimed in claim 11, wherein the cover has a lower edge in which a seal mounting channel is formed and wherein a seal member is mounted in said seal mounting channel and cooperates therewith to form a pressure chamber therebetween and wherein passage means communicates with the pressure chamber through which pressure may be applied to the pressure chamber to press the seal member against the end of a container which is aligned with the cover in use so as to form a seal between the container and the first vacuum chamber in use.

* * * * *

UNITED STATES PATENT AND TRADEMARK OFFICE

CERTIFICATE OF CORRECTION

PATENT NO. : 5,125,785

DATED : June 30, 1992

INVENTOR(S) : Christinaus P. Langen; Johannes C. Langen

It is certified that error appears in the above-identified patent and that said Letters Patent is hereby corrected as shown below:

column 8, line 26, "the" should read "a";

column 8, line 31, "the" should read "a";

column 8, line 39, "the" (second occurrence) should read "a".

Signed and Sealed this

Twenty-first Day of September, 1993

Bruce Lehman

*Attest:*

BRUCE LEHMAN

*Attesting Officer*

*Commissioner of Patents and Trademarks*